US006884996B2

(12) United States Patent
Senko

(10) Patent No.: US 6,884,996 B2
(45) Date of Patent: Apr. 26, 2005

(54) SPACE CHARGE ADJUSTMENT OF ACTIVATION FREQUENCY

(75) Inventor: Michael W. Senko, Sunnyvale, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 10/771,073

(22) Filed: Feb. 2, 2004

(65) Prior Publication Data

US 2004/0245461 A1 Dec. 9, 2004

Related U.S. Application Data

(60) Provisional application No. 60/475,663, filed on Jun. 4, 2003.

(51) Int. Cl.[7] ..... H01J 49/42

(52) U.S. Cl. ..... 250/282; 250/292; 250/283; 250/290

(58) Field of Search ..... 250/282, 292, 250/281, 283, 290

(56) References Cited

U.S. PATENT DOCUMENTS

| | | | | |
|---|---|---|---|---|
| 4,761,545 A | | 8/1988 | Marshall et al. | |
| 5,107,109 A | | 4/1992 | Stafford et al. | |
| 5,128,542 A | * | 7/1992 | Yates et al. | 250/282 |
| 5,420,425 A | | 5/1995 | Bier et al. | |
| 5,448,061 A | * | 9/1995 | Wells | 250/282 |
| 5,572,022 A | | 11/1996 | Schwartz et al. | |
| 6,787,760 B1 | * | 9/2004 | Belov et al. | 250/282 |

OTHER PUBLICATIONS

Michael Senko et al., "*Operation of a Linear Quadrupole Ion Trap Mass Spectrometer Under High Space Charge Conditions*" poster presented at the 51st American Society for Mass Spectrometry (ASMS) Conference on Mass Spectrometry and Allied Topics, Jun. 8–12, 2003, and at the 16th International Mass Spectrometry Society (IMSS) Conference, Aug. 31–Sep. 4, 2003.

Michael L. Easterling et al., "*Routine Part–Per Million Mass Accuracy For High Mass Ions: Space–Charge Effects In MALDI FT–ICR*", Analytical Chemistry, vol. 71, No. 3, Feb. 1, 1999, pp. 624–632.

Schwartz et al., "*A Two–Dimensional Quadrupole Ion Trap Mass Spectrometer*" Journal of The American Society For Mass Spectrometry, vol. 13, Apr. 2002, pp. 659–669.

James W. Hager, "*A New Linear Ion Trap Mass Spectrometer*", Rapid Communications In Mass Spectrometry, 2002, vol. 16, pp. 512–526.

John E.P. Dyka et al., "*Linear Quadrupole Ion Trap Fourier Transform Mass Spectrometer: A New Tool For Proteomics", 49th* ASMS Conference on Mass Spectrometry and Allied Topics, May 2001.

Patrick A. Limbach et al., "*Experimental Determination Of The Number Of Trapped Ions, Detection Limit, And Dynamic Range In Fourier Transform Ion Cyclotron Resonance Mass Spectrometry*", Analytical Chemistry, vol. 62, No. 2, Jan. 1993, pp. 135–140.

* cited by examiner

*Primary Examiner*—Nikita Wells
*Assistant Examiner*—James L. Leybourne
(74) *Attorney, Agent, or Firm*—Fish & Richardson P.C.

(57) ABSTRACT

Methods, systems and apparatus, including computer program products, for operating a quadrupole ion trap in mass spectrometry. A calibrated resonant frequency is determined precursor ions in a first ion population in an ion trap. A frequency adjustment is determined for the precursor ions in a second ion population based on the number of ions in the second ion population. The ion trap is operated using an adjusted resonant frequency that is based on the calibrated resonant frequency and the determined frequency adjustment.

30 Claims, 7 Drawing Sheets

210
Relative Abundance
m/z
524.4
282.7
195.1
307.1
365.1
370.6
469.0
525.5
540.5
541.5
880.9
802.3
844.4
922.0
1022.3
1023.2
1122.2
1130.1
1222.1
1224.1
1322.0
1345.9
1422.0
1423.1
1424.0
1461.0
1521.9
1524.0
1621.9
1623.1
1715.1
1722.0
1782.7
1821.9
1822.8
1882.5
1922.0

220
Relative Abundance
m/z
525.0
195.9
284.1
307.9
366.0
469.7
540.9
541.9
829.7
703.3
822.8
922.5
1022.6
1073.4
1122.5
1148.6
1222.5
1223.5
1224.5
1322.5
1348.3
1422.5
1423.4
1424.4
1522.4
1523.2
1615.3
1622.3
1624.2
1722.2
1815.1
1822.0
1922.0

230
Relative Abundance
m/z
198.1
273.4
280.1
317.5
377.6
472.1
542.7
559.0
611.1
726.7
787.3
923.3
1023.1
1123.1
1224.5
1228.7
1324.9
1328.8
1425.2
1428.3
1525.0
1618.5
1624.0
1717.5
1723.5
1816.5
1823.1
1834.1
1922.7
1983.7

SPACE CHARGE ADJUSTMENT OF ACTIVATION FREQUENCY

CROSS-REFERENCE TO RELATED APPLICATIONS

This application claims the benefit of Provisional Application No. 60/475,663, filed on Jun. 4, 2003, which is incorporated by reference herein

BACKGROUND

The present invention relates to mass spectrometers.

A mass spectrometer analyzes mass-to-charge ratio of particles, such as atoms and molecules, and typically includes an ion source, one or more mass analyzers and one or more detectors. In the ion source, sample particles are ionized. The particles can be ionized with a variety of techniques using electrostatic forces, laser beams, electron beams or other particle beams. The ions are transported to one or more mass analyzers that separate the ions based on their mass-to-charge ratios. The separated ions are detected by one or more detectors that provide data that is used to construct a mass spectrum of the sample.

The ions can be guided, trapped and analyzed by devices such as multipole ion guides or linear or 3D ion traps. For example, multipole rod assemblies, such as quadrupole, hexapole, octapole or greater assemblies, include four, six, eight or more multipole rods, respectively. In the assembly, the multipole rods are arranged to define an internal volume, such as a channel or a ring, in which the ions can be trapped or guided by applying radio frequency ("RF") voltages on the multipole rods. Depending on the applied voltage, the rod assembly can selectively trap, guide or eject ions that have particular mass-to-charge ratios.

For example, a linear ion trap can be used as a stand-alone mass analyzer by applying voltages that eject particles corresponding to different mass-to-charge ratios, and detecting the ejected particles. Alternatively, linear traps can be used in tandem mass spectrometry to isolate or activate particular ions that will be analyzed by another mass analyzer, such as a Fourier transform ion cyclotron resonance ("FTICR") mass analyzer. At isolation, all particles are ejected from the trap except ions within a narrow range of mass-to-charge ratios, called the isolation mass range, that corresponds to masses of target molecules. At activation, the isolated ions, called parent ions or precursor ions, are excited and eventually fragmented into their basic building blocks. Ionized fragments are called daughter ions or product ions. The activation can be performed by applying an AC voltage to multipole rods with an activation frequency corresponding to a resonant frequency of the precursor ions. The mass spectrum of the product ions can be used to determine structural components of the precursor ions.

In a multipole ion trap or ion guide, ions are manipulated by electric fields generated by the voltages applied to the multipole rods or other electrodes of the ion trap or ion guide. In addition to the electric fields generated by the applied voltages, the ions are also subject to electric fields that are generated in the ion trap or ion guide by the ions themselves. The self-generated electric fields have a characteristic strength that increases with the size of the ion population in the ion trap or ion guide. Conventionally, the ion trap or ion guide is operated with ion populations for which the self-generated electric fields are substantially smaller than the applied electric fields. Thus, the number of ions in the ion population is traditionally limited to avoid self-generated fields that may affect one or more particular operations. Such limits are known as space charge limits.

SUMMARY

An activation frequency is adjusted to operate an ion trap when space charge effects are present due to a large number of ions in the trap. Using the adjusted activation frequency can increase the efficiency of activation in the ion trap. In general, in one aspect, the invention provides methods, systems and apparatus, including computer program products, for operating a quadrupole ion trap in mass spectrometry. A calibrated resonant frequency is determined for precursor ions in a first ion population in an ion trap. A frequency adjustment is determined for the precursor ions in a second ion population based on the number of ions in the second ion population. The ion trap is operated using an adjusted resonant frequency that is based on the calibrated resonant frequency and the determined frequency adjustment.

Particular implementations can include one or more of the following features. Operating the ion trap using the adjusted resonant frequency can include operating the ion trap including the second ion population. The number of ions in the second ion population can be substantially larger than the number of ions in the first ion population. The number of ions can be sufficient to result in substantial space charge effects in the second ion population. Operating the ion trap based on the adjusted resonant frequency can include exciting the precursor ions in the ion trap at the adjusted resonant frequency. Exciting the precursor ions at the adjusted resonant frequency can include fragmenting the precursor ions in the ion trap to generate product ions. One or more product ions can be ejected from the ion trap based on the mass-to-charge ratios of the product ions. The mass-to-charge ratios of the ejected product ions can be analyzed. Analyzing the mass-to-charge ratios of the ejected product ions can include analyzing the mass-to-charge ratios of the ejected product ions in an FTICR or any other mass analyzer. The precursor ions can be trapped in the ion trap with an oscillating multipole potential having an amplitude, which can be adjusted to set the adjusted resonant frequency. The adjusted resonant frequency can be smaller than the calibrated resonant frequency. Determining the frequency adjustment for the precursor ions in the second ion population can include estimating the number of ions in the second population.

In general, in another aspect, the invention provides methods, systems and apparatus, including computer program products, for determining a resonant frequency for a population of ions in an ion trap. A calibrated resonant frequency is received for precursor ions in a first ion population in an ion trap, and an estimated number of the ions in a second ion population in the ion trap is also received. The estimated number of the ions and the calibrated resonant frequency is used to determine an adjusted resonant frequency for the precursor ions in the second ion population.

Particular implementations can include one or more of the following features. Using the estimated number of the ions to determine the adjusted resonant frequency can include determining a frequency adjustment based on the estimated number of the ions, and adjusting the calibrated resonant frequency using the determined frequency adjustment. The number of ions in the second ion population can be sufficient to cause substantial space charge effects in the second ion population in the ion trap.

In general, in yet another aspect, the invention provides a mass spectrometry system. The system includes a source of ions, an ion trap operable to receive ions from the source of ions, and a controller to control the ion trap. The controller is configured to perform operations that include determining a calibrated resonant frequency for precursor ions in a first ion population in the ion trap, determining a frequency adjustment for the precursor ions in a second ion population based on the number of ions in the second ion population, and operating the ion trap using an adjusted frequency that is based on the calibrated resonant frequency and the determined frequency adjustment.

Particular implementations can include one or more of the following features. The controller can be configured to fragment the precursor ions in the ion trap based on the adjusted resonant frequency to generate product ions. The controller can be configured to eject one or more product ions from the ion trap based on the mass-to-charge ratios of the product ions. The system can include a mass analyzer to analyze the mass-to-charge ratios of the ejected product ions. The mass analyzer can be an FTICR mass analyzer.

The invention can be implemented to provide one or more of the following advantages. A resonant frequency of ions can be estimated for large ion populations in an ion trap. The resonant frequency can be determined as a function of the number of ions in the trap. The determined resonant frequency can be used as an activation frequency to activate precursor ions in the trap. The activation frequency can be adjusted according to different activation parameters, such as the applied RF voltage and the precursor ion's mass-to-charge ratio. The activation frequency can be adjusted to compensate for space charge effects caused by large ion populations in the trap. The frequency adjustment can also be applied to isolating precursor ions. The adjusted activation frequency can be used to activate a large number of precursor ions in the trap, even if space charge effects are present. For large ion populations, activation is substantially more efficient at the adjusted activation frequency than a frequency calibrated for activation at small ion densities. Using the adjusted activation frequency makes it possible to operate a linear ion trap for isolation and activation well beyond the previously accepted space charge limit. For example, a linear trap for which the accepted spectral space charge limit is about 30,000 ions as a stand-alone mass analyzer can be operated for isolation and activation using an adjusted activation frequency with high efficiency for populations exceeding 500,000 ions. With such a high activation efficiency at large ion populations, the linear trap can provide a sufficient number of product ions to perform a FTICR mass analysis. The large number of product ions may increase signal-to-noise ratio of the FTICR mass analysis, and allow acquiring more precise mass spectra of the product ions.

The details of one or more embodiments of the invention are set forth in the accompanying drawings and the description below. Other features and advantages of the invention will become apparent from the description, the drawings, and the claims.

DETAILED DESCRIPTION

Figure 1A:
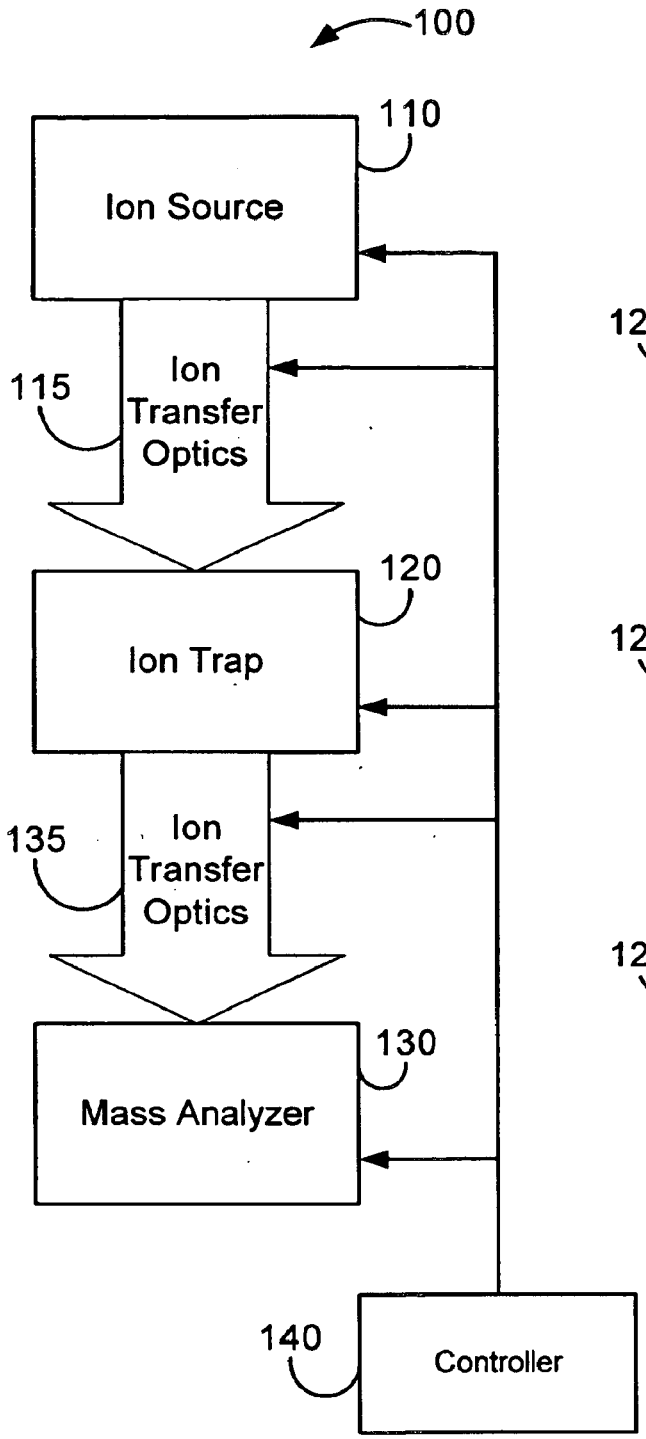
FIGS. 1A and 1B are schematic block diagrams illustrating an exemplary mass spectrometer.

FIG. 1A illustrates an exemplary mass spectrometer 100. The mass spectrometer 100 includes an ion source 110, an ion trap 120, a mass analyzer 130, ion transfer optics 115 and 135 and a controller 140. The ion source 110 generates ions from sample molecules. The generated ions are transported by the ion transfer optics 115 to the ion trap 120. The ion trap 120 isolates precursor ions and activates the precursor ions to fragment them into product ions. The product ions are transported by the ion transfer optics 135 to the mass analyzer 130, which separates different product ions according to their mass-to-charge ratios, and detects the separated ions to acquire a mass spectrum. The elements of the mass spectrometer can be operated by the controller 140.

The ion source 110 ionizes particles such as organic molecules in a biological sample. In one implementation, the ion source 110 uses a laser desorption ionization ("LDI") technique in which laser beam impulses are focused on a surface of a sample to ablate and ionize sample particles. To avoid fragmentation of the sample molecules, the ion source can use matrix-assisted laser desorption ionization ("MALDI") techniques in which sample molecules are embedded in a matrix including small molecules. The matrix molecules absorb the laser's energy, vaporize and drag along the sample molecules, which become ionized by interacting with the vaporized matrix molecules. In alternative implementations, the sample particles can be ionized by chemical ionization, static electric fields or particle beams, such as electron beams.

The ion transfer optics 115 extracts and transports the sample ions, and injects them into the ion trap 120. To guide the sample ions from the sample to the ion trap 120, is the ion transfer optics 115 can include, tube lenses, aperture plate lenses, differential pumping orifices, ion tunnels comprising a plurality of RF electrodes having apertures through which ions are transmitted, or multipole rod assemblies such as one or more quadrupole, hexapole and octapole rod assemblies to define a channel in which the ions are transported.

Figure 1B:
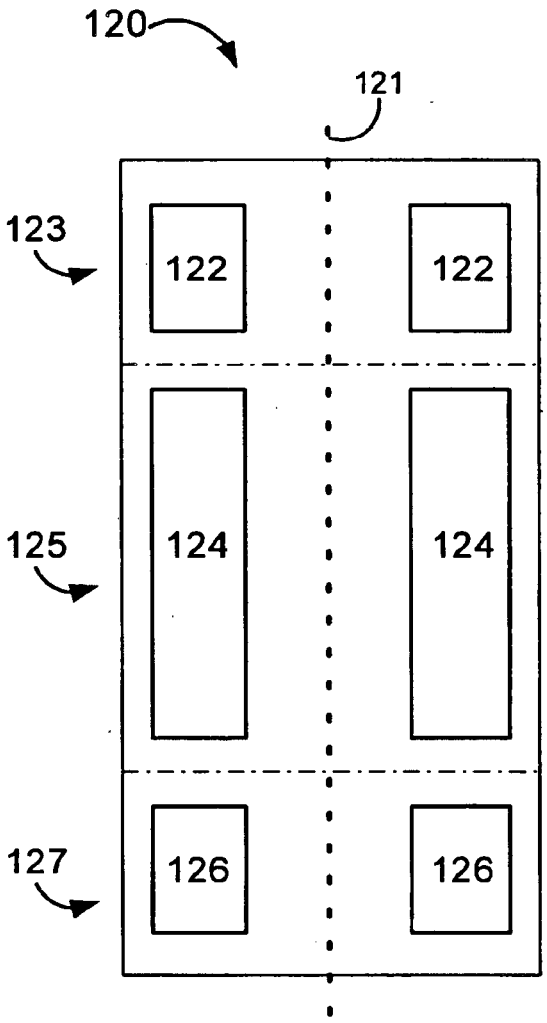

The ion trap 120 receives the sample ions from the ion source 110, isolates precursor ions and activates the isolated precursor ions to fragment them into product ions. An exemplary implementation of the ion trap 120 is illustrated in FIG. 1B. Techniques for using ion traps for isolation and activation are discussed with reference to FIGS. 1C and 3–7.

The ion transfer optics 135, which can include one or more multipole rod assemblies, electromagnetic lenses, tube lenses, ion tunnels, aperture plate lenses or differential pump orifices, transports the product ions from the ion trap 120 to the mass analyzer 130.

The mass analyzer 130 separates and detects ions according to their mass-to-charge ratios. In one implementation, the mass analyzer 130 includes an FTICR mass analyzer in which different mass-to-charge ratios are detected by exciting the ions with electromagnetic fields and measuring the ions' response to the excitation. In alternative implementations, the mass analyzer 130 can be a time-of-flight analyzer, in which the entire charge of the ions is detected. That is, the presence of the ions is detected, not just the ions' response to excitations, as in the FTICR analyzer.

The controller 140 can operate one or more elements of the mass spectrometer 100. For example, the controller 140 can include data processing apparatus, such as a computer, that performs instructions of a computer program. The controller 140 can also provide a user interface for a human operator to receive instructions for operating the mass spectrometer.

FIG. 1B illustrates an exemplary implementation of the multipole ion trap 120. In this implementation, the ion trap 120 is a linear trap, such as a 62 mm linear trap, that includes a first end section 123, a middle section 125 and a second end section 127. Each of the sections 123, 125 and 127 includes a corresponding multipole rod assembly 122, 124 and 126, respectively. For example, each of the rod assemblies 122, 124 and 126 is a quadrupole rod assembly that includes four quadrupole rods. The multipole rod assemblies define a volume about an axis 121 of the ion trap 120 to guide and trap ions.

In general, the ions are confined in the ion trap 120 during an operation in an internal volume, which is referred to as an active region. The active region is a region of the middle section 125, that is defined by the two end sections 123 and 127. To trap the ions in the ion trap 120, the two end sections 123 and 127 confine the ions axially within middle section 125, while the multipole rods 124 radially confine the ions. For the 62 mm linear trap, each of the end sections 123 and 127 has a length of about 12 mm, and the active region has a length of less than about 35 mm. In alternative implementations, the ion trap can be a circular trap, a three dimensional trap, or a trap with another geometry, such as the geometries described in U.S. Pat. No. 5,420,425.

Figure 2A:
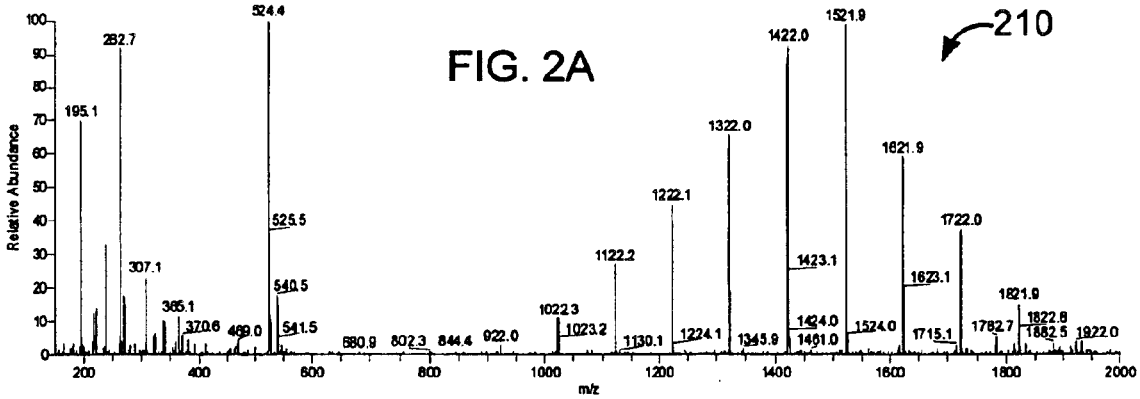
FIGS. 2A–2C are diagrams illustrating exemplary mass spectra acquired by an ion trap as a stand-alone mass analyzer.
Figure 2B:
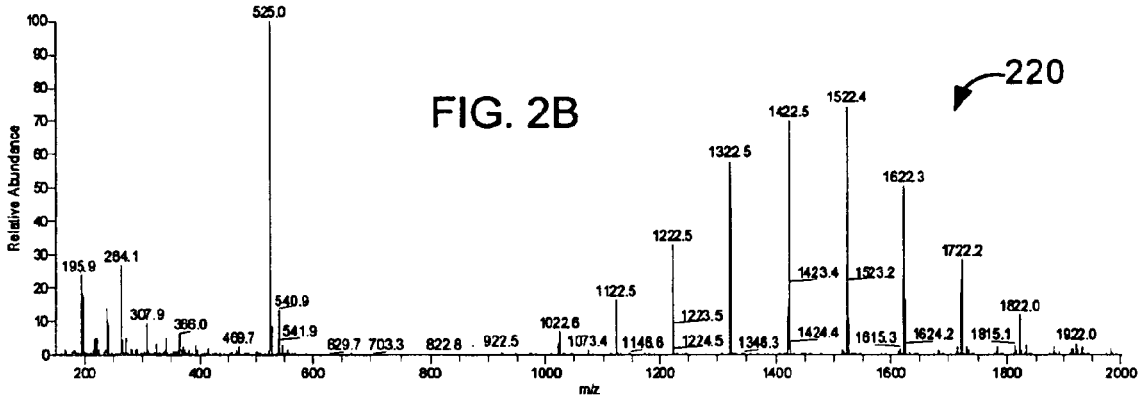
Figure 2C:
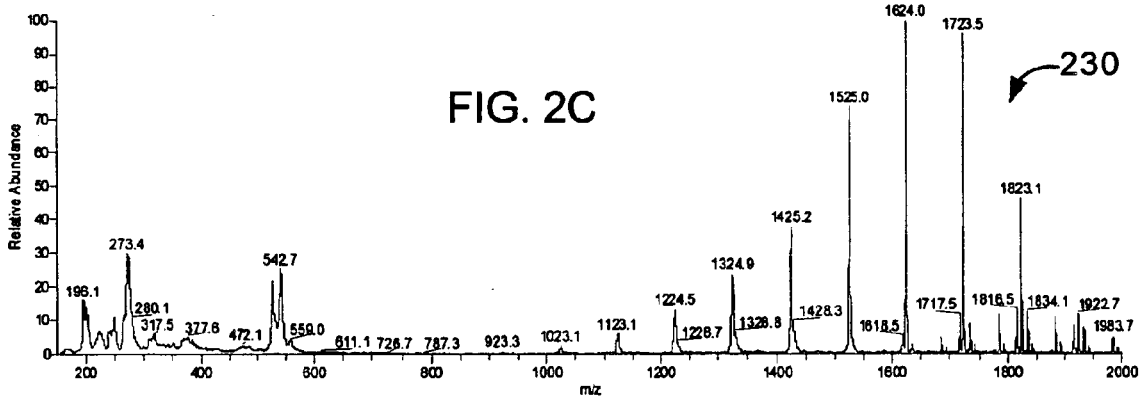

The ion trap 120 can be used as a stand-alone analyzer to analyze the product ions in a scanning mode. In the scanning mode, the trapped product ions are selectively ejected by applying different voltages to eject ions with different mass-to-charge ratios. The mass spectrum is obtained by detecting the ejected particles using a detector system that includes one or more electron or photo multipliers. Electron and photo multipliers detect the entire charge of the ions and provide high gain with low noise. Thus the multipliers can produce useful signals even when a single ion strikes the detector system. Exemplary mass spectra acquired by an ion trap in a scanning mode are illustrated in FIGS. 2A–2C.

When the ion trap 120 is a short linear trap, it traditionally accommodates 20,000–50,000 ions without suffering from space charge effects. In a configuration where the linear trap provides ions for an FTICR analyzer, the 20,000–50,000 ions may be insufficient to produce acceptable signal-to-noise levels with the FTICR analyzer, which has a lower detection efficiency than the ion trap 120 when used as a stand-alone analyzer. In the FTICR analyzer, the ions move in a strong magnetic field according to a cyclotron motion and produce an image current, which is detected and analyzed. Currently, the image current cannot be efficiently amplified without increasing the noise. Thus, the FTICR mass analyzer requires more product ions to acquire mass spectra with the same signal-to-noise ratio than the linear trap in the scanning mode. For example, a typical FTICR analyzer provides a three-to-one signal-to-noise ratio for 180 ions that have the same mass-to-charge ratio. The frequency of the image current, however, can be determined very precisely, leading to high resolution and mass accuracy in the acquired spectra.

Figure 1C:
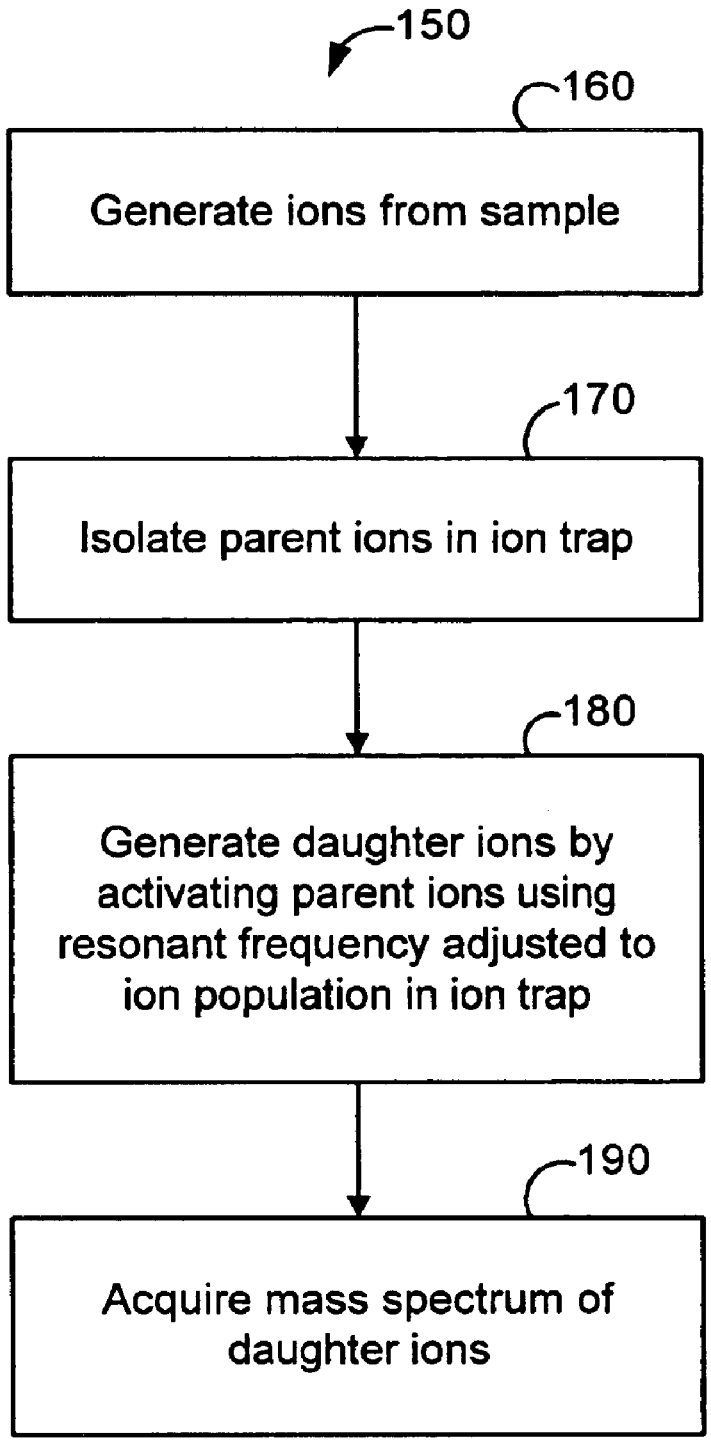
FIG. 1C is a schematic flowchart illustrating a method for mass spectrometry.

FIG. 1C illustrates a method 150 for performing mass spectrometry analysis. The method 150 can be performed by the mass spectrometer 100.

The ion source 110 generates ions from a sample (step 160) and the ion trap 120 isolates precursor ions from the generated ions (step 170). To isolate precursor ions with particular mass-to-charge ratios, the generated sample ions are first injected into the ion trap 120. Next, the ion trap ejects sample ions that have mass-to-charge ratios other than the mass-to-charge ratios of the precursor ions. Thus only the precursor ions remain trapped in the ion trap 120. Optionally, the ion trap 120 can receive the sample ions and eject some of the non-precursor ions simultaneously, as further discussed with reference to FIG. 3.

Product ions are generated by activating the precursor ions using an activation frequency that is adjusted to the ion population in the ion trap 120 (step 180). The precursor ions are activated by applying electromagnetic fields that excite the precursor ions until they break into fragments. The excited precursor ions may fragment by colliding with other particles, such as molecules of background gases in the ion trap. The precursor ions absorb more energy from the applied fields and the activation becomes more effective if the applied electromagnetic field has a frequency that is close to or at a resonant frequency of the precursor ions. Activation at different frequencies is further discussed with reference to FIGS. 5A–5C.

The resonant frequency depends on the ion population. The larger the number of the ions in the ion trap 120, the more the ions interact with each other. Thus the interactions between the ions may become significant relative to the electric fields generated by voltages applied to electrodes in the ion trap. Thus, the applied electric fields may be screened inside the ion trap by a non-uniform charge distribution created by the ions in the trap. These and other space charge effects create a difference between the applied electric field and the electric field felt by the ions in the trap. These differences may affect scanning, isolation and activation modes of the ion trap. For example, the space charge effects may alter the resonant frequency for activation. The resonant frequency can be determined for large ion populations as discussed below with reference to FIG. 4.

The mass analyzer 130 acquires a mass spectrum of the product ions (step 190). The acquired spectrum identifies different masses of the product ions and a relative number of product ions for each of the different masses. Because the product ions have been generated from the precursor ions, the mass spectrum of the product ions can be used to identify structural components of the precursor ions. In one implementation, the mass analyzer 130 is a FTICR mass analyzer that provides high resolution and accurate mass detection for the mass spectrum of the product ions while the ion trap 120 provides an easy-to-use device for isolation and activation.

FIGS. 2A, 2B and 2C illustrate exemplary mass spectra 210, 220 and 230, respectively, acquired by an ion trap in a scanning mode as a stand-alone mass analyzer. Each of the mass spectra is acquired by scanning different mass-to-harge ratios using resonant ejection.

Ions are trapped in an active region of the linear ion trap by an oscillating quadrupole field generated by an RF electric signal applied to the quadrupole rods of the linear trap. The oscillating field traps ions in the active region with different stability that depends upon the ions' mass-to-charge ratios. Stability of the trapped ions can be measured by a stability parameter ("q") that depends on the angular frequency ("ω") and amplitude ("V") of the applied RF signal, the ions' mass-to-charge ratio ("m/z") and the size and geometry of the active region. For a linear trap with a characteristic inner radius ("r") of the active region, the stability parameter q can be calculated as $$q=cV/(\omega^2 r^2 m/z), \quad \text{(Eq. 1)}$$

where c is a constant. Ions are trapped if their stability parameter q is in a stability range. The stability range depends on parameters such as bias of the RF signal. In one implementation, the stability range includes stability parameter values between about zero and about 0.9.

Ions can be ejected from the trap by applying an additional AC signal to the linear trap. The AC signal has a frequency that substantially matches a resonant frequency ("ν") of ions with a particular stability parameter q. At small ion populations where the self-generated electric fields are insignificant relative to the applied electric fields, the is resonant frequency ν depends on the stability parameter q according to a known function that is substantially linear for q<0.4 and includes non-linear contributions for larger values. When the AC signal is applied, the ions with the corresponding stability parameter value q absorb energy from the applied signal and become unstable, while ions with other stability parameter values receive substantially no energy from the signal and remain trapped.

In a scanning mode, ions with different mass-to-charge ratios are sequentially ejected by applying their resonant frequency to generate the mass spectrum. For example, the frequency of the AC signal is kept at a constant value corresponding to a resonance at a particular stability parameter value, such as q=0.88, and the different mass-to-charge ratios are scanned by changing the amplitude of the RF signal. As the RF amplitude changes, different mass-to-charge ratios are represented by the particular stability parameter value of the scan. Alternatively, the frequency of the AC-signal can be changed to scan different stability parameter values.

Each of the mass spectra 210, 220 and 230 represents a mass spectrum that is generated using resonance ejection. Each mass spectrum associates mass-to-charge ratios (m/z, horizontal axis) with a corresponding relative number of ejected ions (vertical axis). The mass spectra 210, 220 and 230 are acquired using the same standard calibration mixture of ions, without additional isolation or activation, for ion populations of different sizes. The mass spectrum 210 (FIG. 2A) corresponds to a first ion population of about 30,000 ions in the trap; the spectrum 220 (FIG. 2B) corresponds to a second ion population of about 300,000 ions in the trap; and the spectrum 230 (FIG. 2C) corresponds to a third ion population of about 3,000,000 ions in the trap.

In the example, the first ion population of 30,000 ions is the spectral space charge limit of the ion trap. Above the spectral space charge limit, space charge effects distort the mass-to-charge ratios in the acquired spectrum by more than about 0.1 m/z. Accordingly for the second ion population of 300,000, the peaks in the acquired spectrum are shifted to higher mass-to-charge ratios relative to the spectrum at the first population. The shifts are typically larger than 0.1 m/z, although in a non-uniform way. That is, the amount of the shift is different at different mass-to-charge ratios. At the third ion population of 3,000,000, the peaks in the acquired spectrum have a substantially distorted shape in addition to a larger shift relative to the spectrum at smaller populations. This demonstrates that above the spectral space charge limit, the ion trap generates a non-uniformly distorted spectrum when used as a stand-alone mass analyzer.

Figure 3:
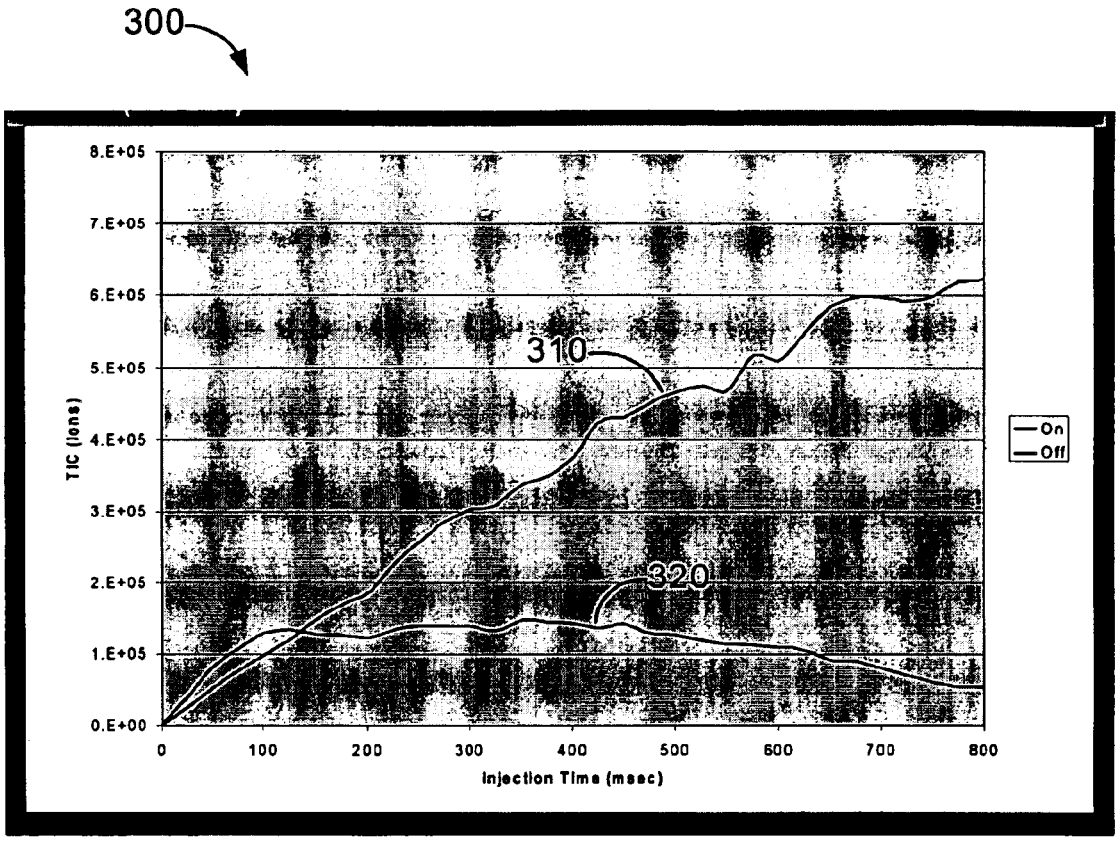
FIG. 3 is a schematic diagram illustrating isolating precursor ion populations in an ion trap.

FIG. 3 illustrates a schematic diagram 300 representing the number of precursor ions isolated in an ion trap as a function of injection time. The number of ions the ion trap can contain is limited by a storage space charge limit, which is proportional to the length of the active region of the trap, and depends on the RF signal applied to the ion trap. For example, for the 62 mm linear trap discussed above, the storage space charge limit is more than 5 million ions for standard RF signals. Above 5 million ions, the linear trap may be unable to effectively store ions with large mass-to-charge ratios, such as mass-to-charge ratios above one thousand five hundred. For obtaining good signal-to-noise ratios using a FTICR mass analyzer, the trap can be filled with about one million ions.

Typically, the ion trap receives many different sample ions, of which the precursor ions to be isolated make up only a small fraction. Therefore, it can be advantageous to continuously eject unwanted ions with a tailored waveform during the injection process. For example, with the standard calibration mixture shown in FIG. 2, the precursor ions having mass-to-charge ratios of about 524 contribute only about ten percent of the total ion population. The unwanted ions can be ejected with tailored waveforms, for example, as described in U.S. Pat. No. 4,761,545.

A schematic function 310 illustrates that, when unwanted ions are ejected as ions are being injected in the ion trap, the number of isolated precursor ions monotonically increases with time. Thus a final isolation in the ion trap can be performed on an ion population that consists primarily of the desired precursor ions.

A schematic function 320 illustrates that, without simultaneous ejection, the number of isolated precursor ions is substantially smaller. Without simultaneous ejection, the total ion population in the ion trap can be as much as about ten times larger at some time during the isolation. The large ion population generates large space charge effects that may shift the desired precursor ions outside of the narrow range of stable masses created during the isolation process. The space charge shift may be large enough to shift the desired precursor ions almost entirely outside the stable isolation mass range, is as shown by the decrease of the schematic function 320 at injection times beyond 400 msec.

The maximum number of precursor ions that an ion trap can isolate is referred to as an isolation space charge limit. As shown by the schematic functions 310 and 320, the isolation space charge limit can be more than five times larger using simultaneous ejection than without it.

Isolation in the ion trap is less susceptible to space charge effects than acquiring a mass spectrum with the ion trap in a scanning mode. When the ion trap is a stand-alone mass analyzer, the space charge effects may cause shifts in the acquired mass spectrum at large ion populations. While these shifts are typically unacceptable in the acquired mass spectrum, the same shifts may be insufficient to destabilize a precursor ion of interest during isolation.

Figure 4:
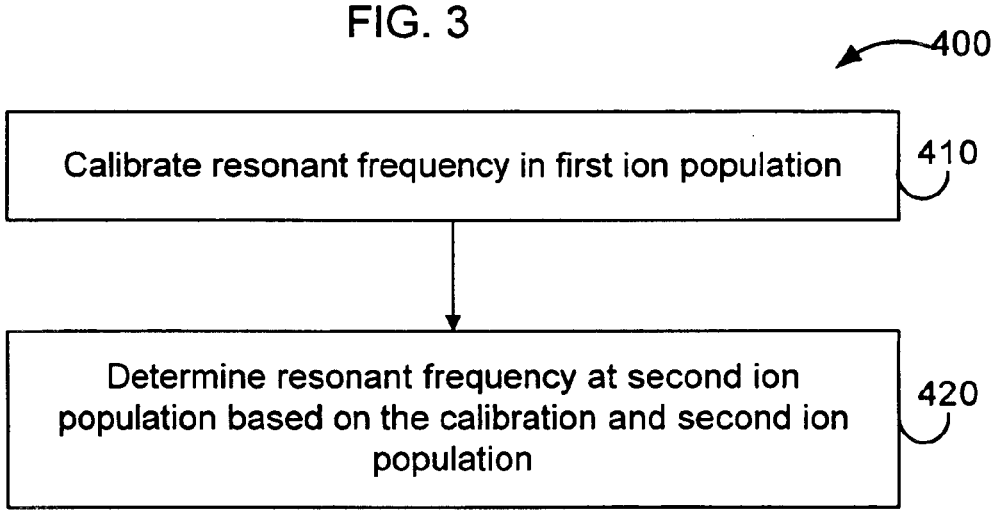
FIG. 4 is a schematic flowchart illustrating a method for determining a resonant frequency of ions in an ion trap.

FIG. 4 illustrates a method 400 for determining resonant frequencies at different ion populations in an ion trap. The determined resonant frequencies can be used for activating precursor ions in the ion trap.

A resonant frequency is calibrated for a precursor ion in a first ion population in the ion trap (step 410). The first ion population can include a relatively small number of ions for which space charge effects are negligible. In a 62 mm linear trap, the first ion population can include less than about 10,000 ions. During calibration, an AC signal with a characteristic frequency is applied to excite the precursor ions trapped in the ion trap by fields generated using an RF signal. The resonant frequency is found by maximizing energy absorption of the precursor ions. To maximize the energy absorption, the amplitude of the RF signal is optimized and the characteristic frequency of the AC signal is kept constant. Alternatively, the frequency of the AC signal can be varied to maximize the energy absorption while the RF amplitude is unchanged. At the maximum absorption, the frequency of the AC signal is the calibrated resonant frequency of the precursor ions for the corresponding amplitude of the RF signal.

At another RF amplitude or for precursor ions having another mass-to-charge ratio, the resonant frequency can be determined by standard theoretical formulas. For example according to Eq. 1, at a constant angular frequency ω of the RF signal, the RF amplitude V is proportional to a coefficient ("K"), the stability parameter q and the mass-to-charge ratio m/z of the precursor ion as $$V=Kqm/z, \quad \text{(Eq. 2)}$$

Because the stability parameter q is related to the resonant frequency and the RF frequency, the coefficient K can be determined from the calibration using the applied resonant frequency and the corresponding RF amplitude V for a precursor ion with known mass-to-charge ratio m/z. Once the coefficient K is known, the resonant frequency or the corresponding RF amplitude V can be calculated for any particular mass-to-charge ratio.

Optionally, the calibration can be repeated for different parameter values to detect deviations from the predicted theoretical values. The deviations can be caused by non-linearities that theory does not predict, such as non-linear quadrupolar potentials or non-linear pressure variations. In one implementation, two calibrations are performed for two different frequencies of the AC signal. Each calibration can use the same precursor ion and frequency of the trapping RF signal, and vary the amplitude of the trapping RF signal. For each frequency of the AC signal, the calibration gives an RF amplitude corresponding to the resonance. If these amplitudes deviate from the theoretical values, interpolation or extrapolation techniques can be used to predict deviations for other AC frequencies or RF amplitudes.

A resonant frequency is determined for a second ion population based on the initial calibration and the second ion population (step 420). The second ion population can include a large number of ions for which space charge effects are present. In a 62 mm linear trap, the second ion population can include more ions than the spectral space charge limit of about 30,000 ions. For example, the second ion population can include from about 500,000 to about one million ions. Such ion populations can provide sufficient number of product ions for a subsequent mass analysis by a FTICR mass analyzer as shown in FIG. 1A.

The resonant frequency ("$\upsilon_{opt}$") at the second ion population depends on a calibrated frequency ("$\upsilon_{cal}$") and a space charge adjustment ("δ") as $$\upsilon_{opt}=\upsilon_{cal}-\delta. \quad \text{(Eq. 3)}$$

The calibrated frequency $\upsilon_{cal}$ is the resonant frequency calculated according to the calibration. If the trapping RF signal has the same frequency as during calibration, the calibrated frequency can be calculated as discussed above with reference to Eq. 2. If the trapping RF signal has a different frequency than during calibration, the calibrated frequency can be calculated with other known theoretical formulas, such as Eq. 1, that describe dependencies on the frequency of the trapping RF signal. Optionally empirical interpolation or extrapolation formulas can also be used to calculate the calibrated frequency.

The space charge adjustment δ describes a difference between the calibrated resonant frequency, which is based on the calibration at the first ion population, and the resonant frequency that provides resonance for the second ion population. The space charge adjustment δ depends on the number of ions in the second ion population. Typically, the larger the number ("N") of the ions in the second ion population, the larger the space charge adjustment and, according to Eq. 3, the smaller the resonant frequency at the second ion population. For some ion traps or ion populations, however, the space charge adjustment δ may have a negative sign or a different dependence on the number of ions in the population.

The total number of ions in the trap can be determined by ejecting the ions from the ion trap and detecting the ejected ions by electron or photo multipliers similar to acquiring a mass spectrum with the ion trap as a stand-alone mass analyzer. Based upon the detected signals, the number of ions in the ion trap can be determined by adjusting the gain of the electron or photo multipliers and the conversion function of the current-to-voltage circuitry.

The space charge adjustment δ also depends on the amplitude V of the trapping RF signal. Typically, the larger the RF amplitude, the smaller the space charge adjustment. If space charge effects are negligible at the first ion population, the space charge adjustment depends on the second ion population and the RF amplitude substantially as $$\delta=A'N/V, \quad \text{(Eq. 4a)}$$

where A' is an empirical coefficient. As discussed above with reference to Eq. 2, the RF amplitude V is proportional to the mass-to-charge ratio r m/z of the precursor ion and the stability parameter q. Accordingly, Eq. 4a can be rewritten as $$\delta = \frac{AN}{qm/z} \quad \text{(Eq. 4b)}$$

where A is another empirical coefficient. The coefficient A (or A') can be determined by finding the resonant frequencies for ion populations containing different number of ions at the same stability parameter q and mass-to-charge ratio m/z of the precursor ion. Typically, the coefficient A depends on the frequency of the trapping RF signal and the geometry of the ion trap.

The space charge adjustment δ can also depend on other parameters of the ion trap or the activation process. For example, the space charge adjustment may depend on a damping gas pressure within the ion trap, or the number of ions in the first ion population. Such dependencies are predictable based on calibrating the resonance at different ion populations and different parameters. Thus the space charge adjustment may be a more complex function of the ion population, the stability parameter or the mass-to-charge ratio of the precursor ions than described by Eqs. 3–4b. These more complex functions can be modeled by non-linear functions or by introducing dependencies into the coefficient A.

Based on Eq. 3, corresponding formulas can be generated for resonance parameters other than the resonant frequency. For example, Eq. 3 and the relation between the resonant frequency and the RF amplitude can be used to determine a resonant amplitude of the trapping RF signal at a fixed frequency of the AC signal. Thus an adjustment to a calibrated RF amplitude can be specified for ion populations including different numbers of ions. Because the frequency adjustment decreases the calibrated frequency as the number of ions increases in the ion population, the corresponding amplitude adjustment increases the RF amplitude.

Figure 5A:
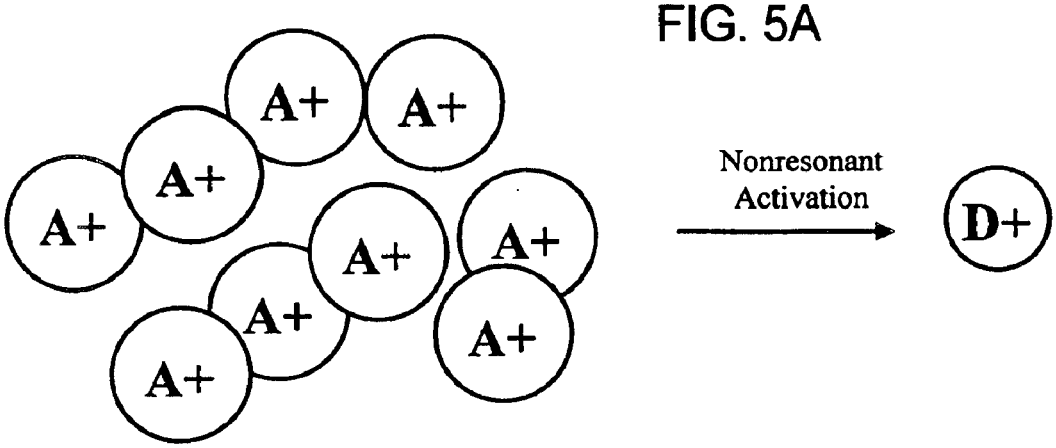
FIGS. 5A–5C are schematic diagrams illustrating activating precursor ions with different frequencies.
Figure 5B:
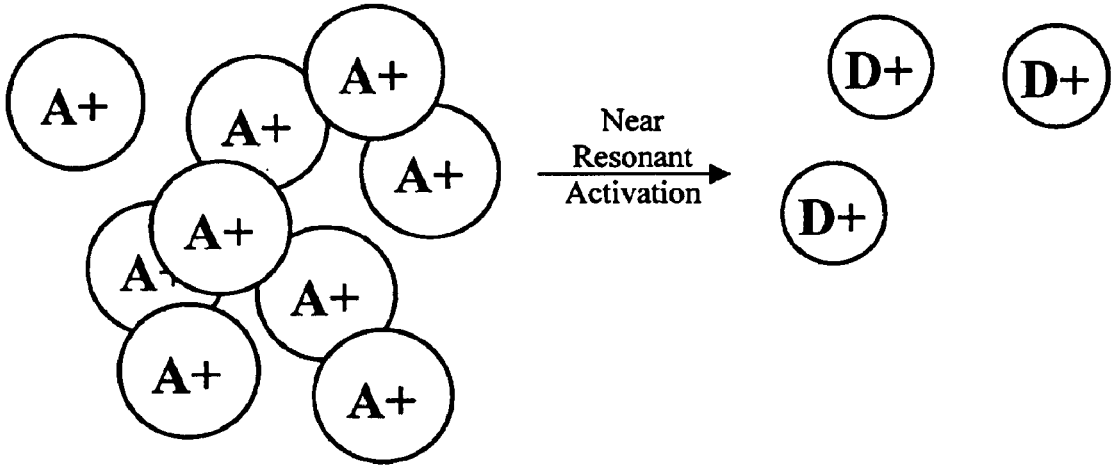
Figure 5C:
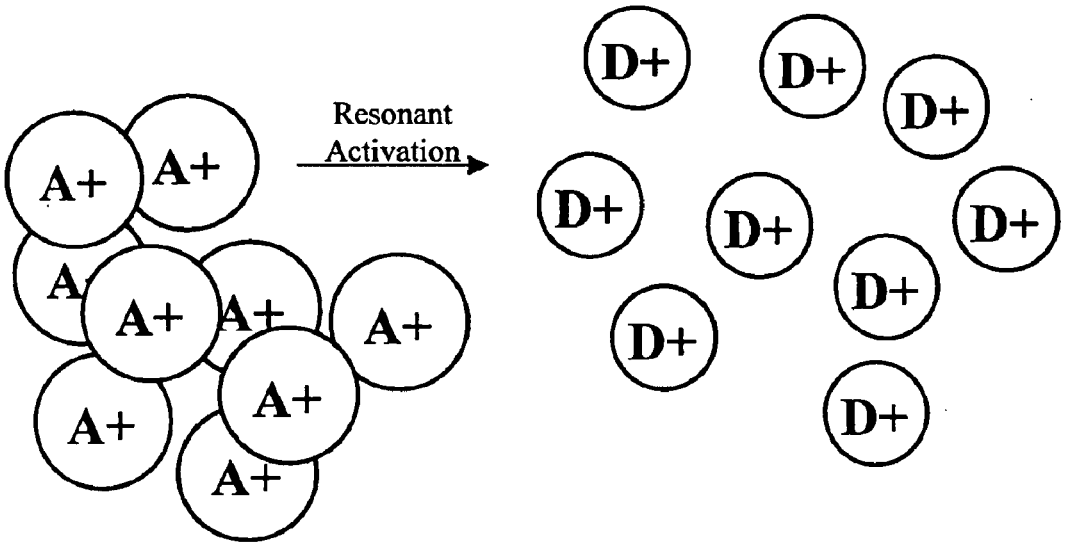

FIGS. 5A–5C illustrate activating precursor ions ("A+") with AC signals that have different frequencies. As shown in FIG. 5A, if the AC signal has a frequency other than the resonant frequency, the precursor ions absorb a small amount of energy from the AC signal and only a few fragments (product ions "D+") are generated by the activation. Non-resonant activation may occur when the population of precursor ions exhibits large space charge effects and the precursor ions are excited using an activation frequency that is calculated based on a calibration at ion populations including a small number of ions for which space charge effects are negligible.

As shown in FIG. 5B, more product ions are generated when the activation frequency is near to the resonant frequency of the precursor ions. Near-resonant frequency activation may occur when the population of precursor ions exhibits small space charge effects and the precursor ions are excited using an activation frequency that is not adjusted to the ion population, or when the activation frequency is adjusted to the ion population, but a non-optimal adjustment has been made.

As shown in FIG. 5C, when the activation frequency matches the resonant frequency, the precursor ions absorb most of the energy of the AC signal and they fragment into a large numbers of product ions 32. As discussed above with reference to FIG. 4, the activation frequency can be adjusted to ion populations that include a large number of ions. Thus efficiency of the activation can be substantially improved by adjusting the activation frequency to the resonant frequency in the ion population.

Figure 6:
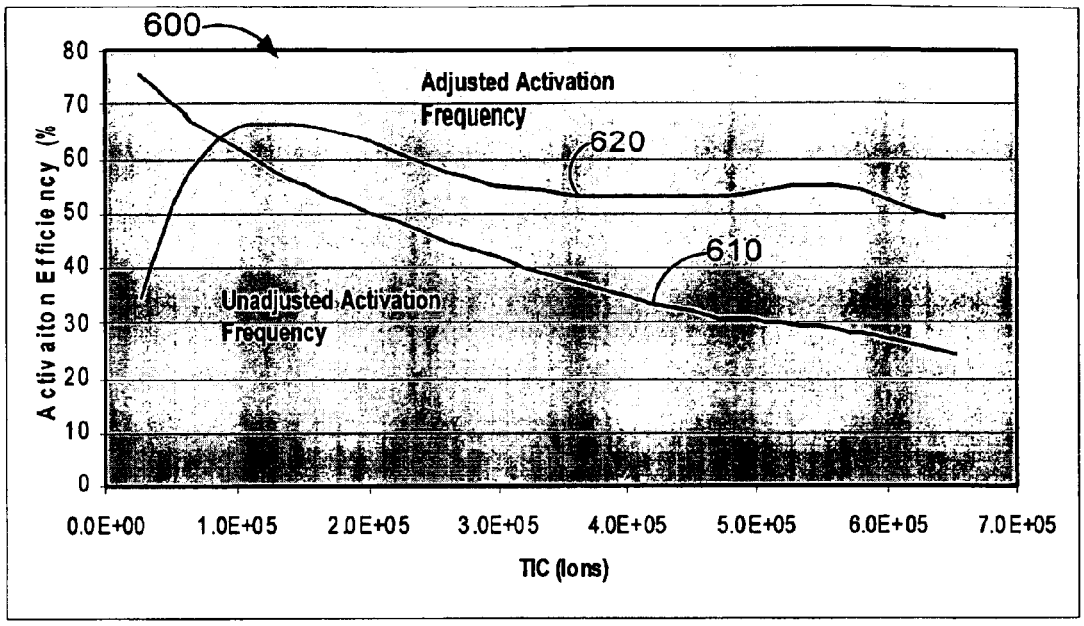
FIGS. 6 and 7 are schematic diagrams illustrating activation efficiencies of an ion trap for different activation parameters.

FIG. 6 is a schematic diagram 600 illustrating activation efficiency in a linear ion trap, such as the 62 mm linear ion trap. The activation efficiency is illustrated in percentages (vertical axis) for different ion populations including from about 30,000 to about 650,000 ions (horizontal axis). Precursor ions are activated by applying an AC signal in addition to an RF trapping signal to the ion trap. The frequency of the AC signal is referred to as the activation frequency.

The diagram 600 illustrates a first function 610 and a second function 620. The first function 610 specifies activation efficiencies when the activation frequency is based on a calibration at ion populations including a small number of ions, such as about 10,000 ions, and the activation frequency has not been adjusted to larger ion populations. In this example, the first function 610 specifies a large activation efficiency of about 75% for ion populations including about 30,000 ions. As the number of ions increases in the population, the activation efficiency decreases. For a population of about 650,000, the efficiency decreases to about 25%. The decrease is believed to be caused primarily by a difference between the resonant frequency calibrated at small ion populations and the actual resonant frequency of the precursor ions in a large ion population that is subject to space charge effects.

As discussed above with reference to FIG. 4, the difference between calibrated and actual resonant frequencies is predictable and allows adjustment of the activation frequency to better match the resonant frequency of the precursor ions. Thus the adjustment can enhance activation efficiencies for large ion populations, that is, under high space charge conditions.

The second function 620 specifies activation efficiencies when the activation frequency is adjusted to compensate for larger ion populations. In one implementation, the activation frequency is reduced by about 1.5 kHz without altering the trapping RF signal. Due to the adjustment, the second function 620 describes an activation efficiency that remains above 50% even for large ion populations including up to about 650,000 ions. Thus, compared to the unadjusted case characterized by the first function 610, the adjustment of the activation frequency provides about a two-fold increase in activation efficiency for ion populations including about 500,000 ions. For larger ion populations, the increase may be even larger. Alternatively or in addition to changing the activation efficiency, the resonant frequency can be adjusted by changing the amplitude of the trapping RF signal.

The diagram 600 illustrates efficiency of an activation that is performed at a relatively small stability parameter value q of about 0.25. The stability parameter can be selected as a compromise between maximizing kinetic energy imparted to the precursor ions and keeping product ions that have the smallest mass-to-charge ratios inside the trap. Because the trapping RF signal's amplitude is proportional to the stability parameter, the RF amplitude has a relatively small value at which activation is more susceptible to space charge effects than isolation. These effects can be decreased by increasing the stability parameter q (and thus the trapping RF signal).

Figure 7:
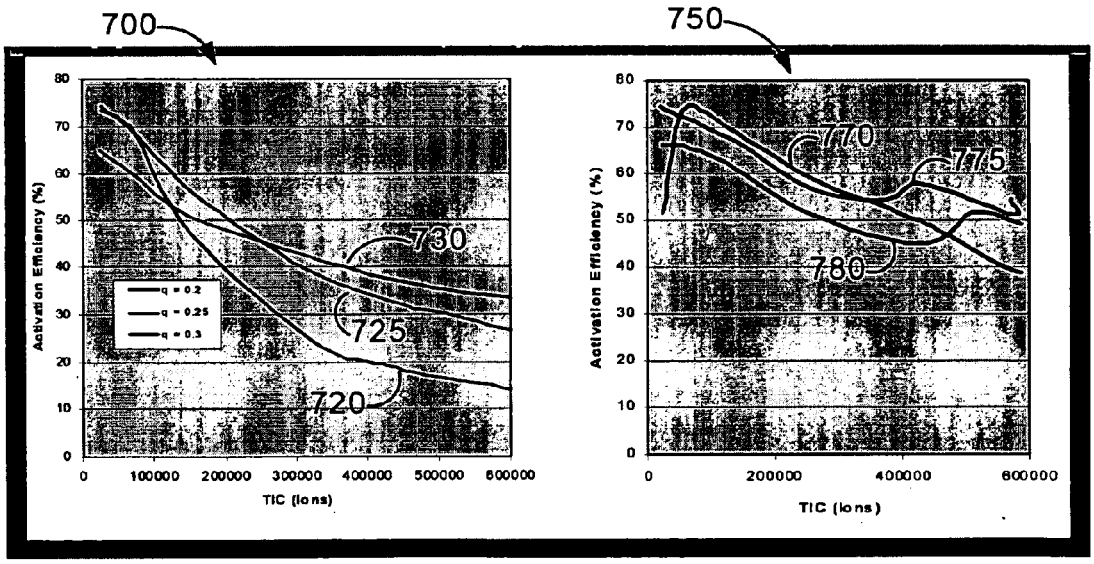

FIG. 7 illustrates schematic diagrams 700 and 750 showing how activation efficiency depends on the value of the stability parameter q in an ion trap that has an ion population including between about 30,000 and about 600,000 ions.

The diagram 700 illustrates activation efficiencies when the activation frequency is calibrated to small ion populations. The diagram 700 illustrates a first 720, a second 725, and a third 730 function describing activation efficiencies for stability parameter values q=0.2, q=0.25 and q=0.3, respectively. Each of these functions describes decreasing activation efficiencies as the ion population increases. The decrease is becoming smaller for larger values of the stability parameter q. For q=0.2 (function 720), the efficiency drops about 60% from about 75% to about 15% as the number of ions increases from 30,000 to 600,000. For the same ion populations at q=0.25 (function 722), the efficiency drops about 50% from about 75% to about 25%. For q=0.3 (function 730), the drop is only about 30% from about 65% to about 35%.

The diagram 750 illustrates activation efficiencies when the activation frequency is adjusted to compensate for large ion populations. The diagram 750 illustrates a fourth 770, a fifth 775, and a sixth 780 function describing activation efficiencies for the same stability parameter values, that is, q=0.2, q=0.25 and q=0.3, as the functions 720, 725 and 730 respectively. For all of these values of the stability parameter q, the adjustment results in substantial improvement in activation efficiency at large ion populations, and these improved activation efficiencies depend less on the stability parameter q.

Figure 8:
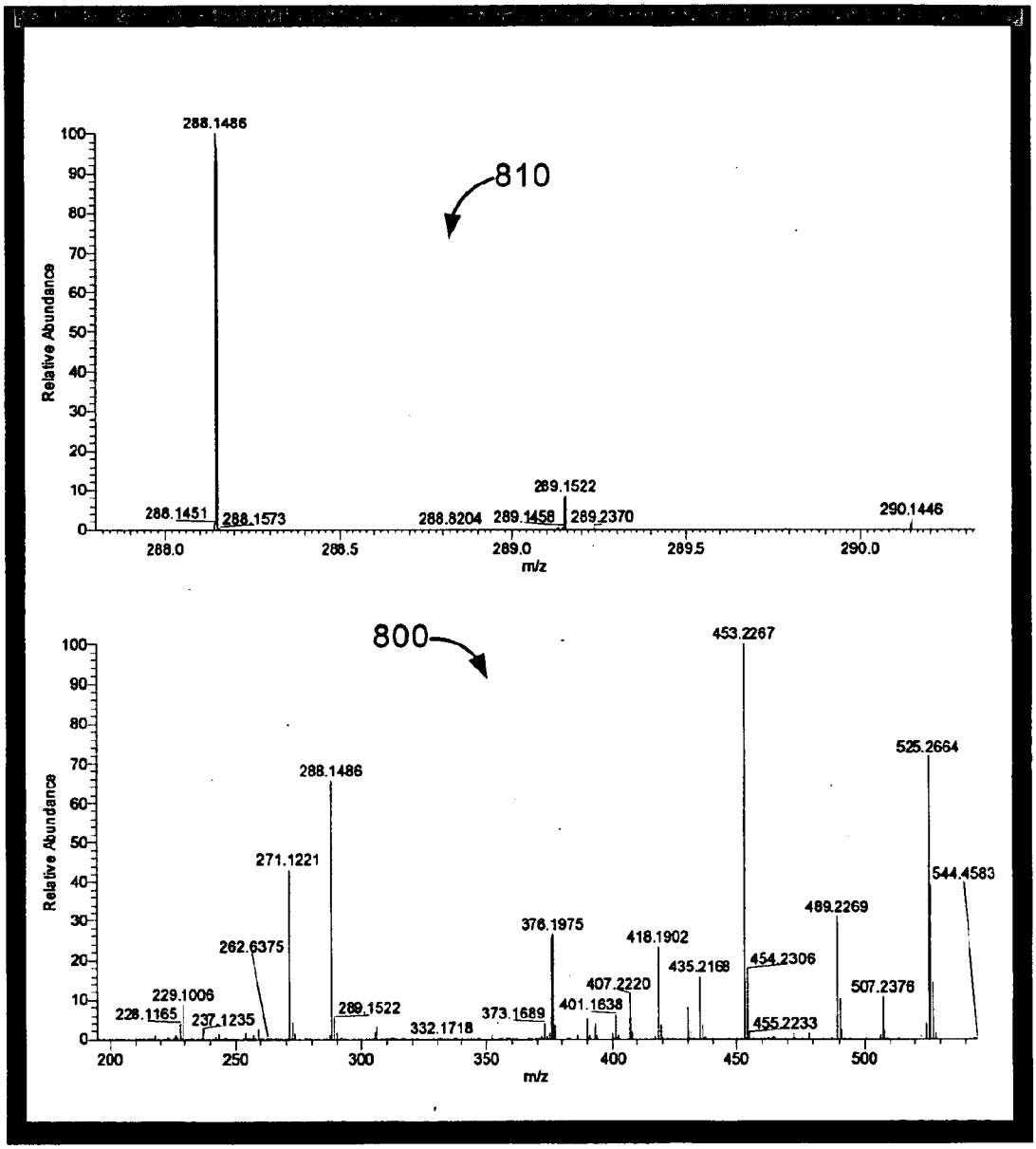
FIG. 8 is a diagram illustrating an exemplary mass spectrum acquired by FTICR analyzer using an ion trap for isolation and activation.

FIG. 8 illustrates a diagram 800 representing an exemplary mass spectrum acquired by an FTICR analyzer using a linear ion trap for isolation and activation. A portion of the mass spectrum 800 is enlarged in a diagram 810.

As shown in FIG. 8, the linear ion trap is capable of isolating and activating ion populations that are sufficient for collecting high quality mass spectra using the FTICR analyzer. In the exemplary mass spectrum, the peptide MRFA (chemical formula $C_{23}H_{37}N_7O_5S$) is isolated and activated in the ion trap using about two million ions. The ions are then transferred to the FTICR analyzer that produces a mass spectrum with a signal-to-noise ratio of approximately 1000:1 for the base peak. The average mass error for the fragments in this spectrum is about 1 part-per-million.

Aspects of the invention, including some or all of the functional operations described herein, can be implemented in digital electronic circuitry, or in computer hardware, firmware, software, or in combinations of them. The methods of the invention can be implemented as a computer program product, i.e., a computer program tangibly embodied in an information carrier, e.g., in a machine-readable storage device or in a propagated signal, for execution by, or to control the operation of, data processing apparatus, e.g., a programmable processor, a computer, or multiple computers. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

Method steps of the invention can be performed by one or more programmable processors executing a computer program to perform functions of the invention by operating on input data and generating output. Method steps can also be performed by, and apparatus of the invention can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in special purpose logic circuitry.

To provide for interaction with a user, the invention can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

A number of embodiments of the invention have been described. Nevertheless, it will be understood that various modifications may be made without departing from the spirit and scope of the invention. For example, the steps of the described methods can be performed in a different order and still achieve desirable results. The described techniques can be applied to other ion traps, such as 3D ion traps.

What is claimed is:

1. A method for operating a quadrupole ion trap in mass spectrometry, the method comprising:

determining a calibrated resonant frequency for precursor ions in a first ion population in an ion trap;

determining a frequency adjustment for the precursor ions in a second ion population based on the number of ions in the second ion population; and operating the ion trap using an adjusted resonant frequency that is based on the calibrated resonant frequency and the determined frequency adjustment.

2. The method of claim 1, wherein:

operating the ion trap using the adjusted resonant frequency includes operating the ion trap including the second ion population.

3. The method of claim 1, wherein the number of ions in the second ion population is substantially larger than the number of ions in the first ion population.

4. The method of claim 3, wherein the number of ions is sufficient to result in substantial space charge effects in the second ion population.

5. The method of claim 1, wherein:

operating the ion trap based on the adjusted resonant frequency includes exciting the precursor ions in the ion trap at the adjusted resonant frequency.

6. The method of claim 5, wherein:

exciting the precursor ions at the adjusted resonant frequency includes fragmenting the precursor ions in the ion trap to generate product ions.

7. The method of claim 6, the method further comprising:

ejecting one or more product ions from the ion trap based on the mass-to-charge ratios of the product ions.

8. The method of claim 7, further comprising:

analyzing the mass-to-charge ratios of the ejected product ions.

9. The method of claim 8, wherein:

analyzing the mass-to-charge ratios of the ejected product ions includes analyzing the mass-to-charge ratios of the ejected product ions in an FTICR mass analyzer.

10. The method of claim 1, further comprising:

trapping the precursor ions in the ion trap with an oscillating multipole potential having an amplitude; and adjusting the amplitude of the oscillating multipole potential to set the adjusted resonant frequency.

11. The method of claim 1, wherein:

the adjusted resonant frequency is smaller than the calibrated resonant frequency.

12. The method of claim 1, wherein:

determining the frequency adjustment for the precursor ions in the second ion population includes estimating the number of ions in the second population.

13. A method for determining a resonant frequency for a population of ions in an ion trap, the method comprising:

receiving a calibrated resonant frequency for precursor ions in a first ion population in an ion trap;

receiving an estimated number of the ions in a second ion population in the ion trap; and using the estimated number of the ions and the calibrated resonant frequency to determine an adjusted resonant frequency for the precursor ions in the second ion population.

14. The method of claim 13, wherein using the estimated number of the ions to determine the adjusted resonant frequency includes:

determining a frequency adjustment based on the estimated number of the ions; and adjusting the calibrated resonant frequency using the determined frequency adjustment.

15. The method of claim 13, wherein the number of ions in the second ion population is sufficient to cause substantial space charge effects in the second ion population in the ion trap.

16. A software product, tangibly embodied in a machine-readable medium, for determining a resonant frequency for a population of ions in an ion trap, the software product comprising instructions operable to cause one or more data processing apparatus to perform operations comprising:

receiving a calibrated resonant frequency for precursor ions in a first ion population in an ion trap;

receiving an estimated number of the ions in a second ion population in the ion trap; and using the estimated number of the ions and the calibrated resonant frequency to determine an adjusted resonant frequency for the precursor ions in the second ion population.

17. The software product of claim 16, wherein using the estimated number of the ions to determine the adjusted resonant frequency includes:

determining a frequency adjustment based on the estimated number of the ions; and adjusting the calibrated resonant frequency using the determined frequency adjustment.

18. The software product of claim 16, wherein the number of ions in the second ion population is sufficient to cause substantial space charge effects in the second ion population in the ion trap.

19. A mass spectrometry system, comprising:

means for determining a calibrated resonant frequency for precursor ions in a first ion population in an ion trap;

means for determining a frequency adjustment for the precursor ions in a second ion population based on the number of ions in the second ion population; and means for operating the ion trap including the second ion population using an adjusted resonant frequency that is based on the calibrated resonant frequency and the determined frequency adjustment.

20. The system of claim 19, wherein the number of ions is sufficient to result in substantial space charge effects in the second ion population.

21. The system of claim 19, wherein:

the means for operating the ion trap is operable to excite the precursor ions in the ion trap at the adjusted resonant frequency.

22. The system of claim 21, wherein:

the means for operating the ion trap is operable to fragment the precursor ions in the ion trap based on the adjusted resonant frequency to generate product ions.

23. The system of claim 22, wherein:

the means for operating the ion trap is operable to eject one or more product ions from the ion trap based on the mass-to-charge ratios of the product ions.

24. The system of claim 23, further comprising:

a mass analyzer to analyze the mass-to-charge ratios of the ejected product ions.

25. The system of claim 24, wherein the mass analyzer is an FTICR mass analyzer.

26. A mass spectrometry system, comprising:

a source of ions;

an ion trap operable to receive ions from the source of ions; and a controller to control the ion trap, the controller configured to perform operations including:

determining a calibrated resonant frequency for precursor ions in a first ion population in the ion trap;

determining a frequency adjustment for the precursor ions in a second ion population based on the number of ions in the second ion population; and operating the ion trap using an adjusted frequency that is based on the calibrated resonant frequency and the determined frequency adjustment.

27. The system of claim 26, wherein:

the controller is configured to fragment the precursor ions in the ion trap based on the adjusted resonant frequency to generate product ions.

28. The system of claim 27, wherein:

the controller is configured to eject one or more product ions from the ion trap based on the mass-to-charge ratios of the product ions.

29. The system of claim 28, further comprising:

a mass analyzer to analyze the mass-to-charge ratios of the ejected product ions.

30. The system of claim 29, wherein the mass analyzer is an FTICR mass analyzer.

* * * * *